United States Patent [19]

Collet et al.

[11] Patent Number: 4,842,099

[45] Date of Patent: Jun. 27, 1989

[54] FOLDABLE LADDER

[75] Inventors: Dieter Collet, Hemsbach; Emil Freiwald, Ober-Ramstadt, both of Fed. Rep. of Germany

[73] Assignee: Emil Freiwald, Ober-Ramstadt, Fed. Rep. of Germany

[21] Appl. No.: 131,628

[22] Filed: Dec. 10, 1987

[30] Foreign Application Priority Data

Oct. 6, 1987 [DE] Fed. Rep. of Germany ..... 3733702

[51] Int. Cl.[4] ..... E06C 1/383

[52] U.S. Cl. ..... 182/160; 182/96; 182/228

[58] Field of Search ..... 182/159, 160, 96, 156, 182/161, 162

[56] References Cited

U.S. PATENT DOCUMENTS

| | | | |
|---|---|---|---|
| 610,284 | 9/1898 | Schubert | 182/162 |
| 958,732 | 5/1910 | Dennis | 182/160 |
| 2,670,120 | 2/1954 | Sanguineti | 182/160 |
| 2,981,364 | 4/1961 | Webber | 182/159 |
| 3,084,760 | 4/1963 | Lamberti | 182/160 |
| 4,560,030 | 12/1985 | Mucelli | 182/160 |
| 4,618,027 | 10/1986 | Piretti | 182/160 |

FOREIGN PATENT DOCUMENTS

| | | | |
|---|---|---|---|
| 239066 | 3/1965 | Austria | 182/160 |
| 2923397 | 12/1979 | Fed. Rep. of Germany . | |
| 3320519 | 12/1984 | Fed. Rep. of Germany . | |
| 1403008 | 5/1965 | France | 182/160 |

*Primary Examiner*—Reinaldo P. Machado
*Attorney, Agent, or Firm*—Staas & Halsey

[57] ABSTRACT

A foldable ladder has collapsible crosspieces having a 90-degree pivot in the middle, the crosspieces being mounted to opposite side rails likewise having 90-degree pivots. Push rails are provided to the right and left of the crosspiece inside each sidepiece so as to move the ladder between folded and depolyed positions.

12 Claims, 4 Drawing Sheets

FOLDABLE LADDER

BACKGROUND OF THE INVENTION

1. Field of the Invention

The invention relates to a foldable ladder with collapsible crosspieces having a 90-degree pivot in the middle, the crosspieces being mounted to the sidepieces likewise with 90-degree pivots.

2. Description of the Related Art

German Disclosure Publications 29 23 397 and 33 20 519 represent art related to the present invention.

German Disclosure Publication 29 23 397 relates to a folding ladder with two sidepieces, to each of which are hinged two crosspieces. The crosspieces consist of two parts directly hinged together. The individual swivel axes lie parallel to each other and perpendicular to the plane of the ladder, with a rigid, preferably tubular, bar connecting the hinge points of the crosspieces to each other and with a support frame placed below the lowermost crosspiece. The support legs of the support frame are longer than the crosspieces and are hinged to the sidepieces as well as to each other. The tip of the support frame is placed over the ends of the support legs and provides a bearing surface for the lower end of the rigid bar when the ladder is fully expanded. The swivel axes of the legs of the support frame at the sidepieces are placed at immovable points with respect to the sidepieces, and the swivel axis in the region of the hinging of the two support legs is movable with respect to the rigid bar. The abutment face formed by the tip of the support frame is still movable with respect to the rigid bar.

Thus, with this folding ladder of known construction, a central expanding bar has been provided which is not a push rod and is not pushed inside of the sidepiece.

German Disclosure Publication 33 20 519 discloses a folding ladder in which the crosspieces are folded in the middle and are hinged to the sidepieces. It is equipped with centrally located locking rods, which do not constitute a push rod and are not placed or pushed inside a timepiece.

It has been shown that prior art folding ladders cannot always satisfy practical needs. This applies in particular to the execution of a completely uniform double-up movement.

SUMMARY OF THE INVENTION

An object of the present invention is to provide a foldable ladder which enables the crosspieces to double up while at the same time presenting no impediment to a person ascending the ladder.

The object of the present invention is achieved with foldable ladders of the type mentioned in the introduction by fitting to the right and left of the crosspiece stays a cross-piece connecting push rail into each sidepiece.

As load points for the crosspieces, a distance roller may incorporated into the middle hinge as well as into end hinges, supporting the extended crosspiece. In the center of the crosspiece, the step stay on both sides may be formed such that the two stays abut firmly against each other, supporting the pressure point at the crosspiece ends.

Preferably, the ascending rails are U-shaped and the material thickness, in conjunction with the likewise U-shaped crosspiece stays, is selected so that the total stability conforms to the norms adopted for ladders, with appropriate fitted parts ensuring the precision and safety.

One of the main objects of a foldable ladder embodying the invention, in addition to being easily accommodated in the limited space of a motor home, boat or in the house, is that it must also be easily transportable, since the foldable ladder in its folded state displays, roughly, the form of a "bar" with a rectangular cross section.

An aluminum alloy is the preferred material for the components of the foldable ladder, and the rivets preferably consist of chromium nickel steel. Aluminum provides the desired corrosion resistance and weight savings.

BRIEF DESCRIPTION OF THE DRAWINGS

The details of the instant invention will be discussed in greater detail with reference to the accompanying FIGS. 1 through 10, which represent preferred embodiments, in which.

DETAILED DESCRIPTION OF THE PREFERRED EMBODIMENTS

Figure 2:
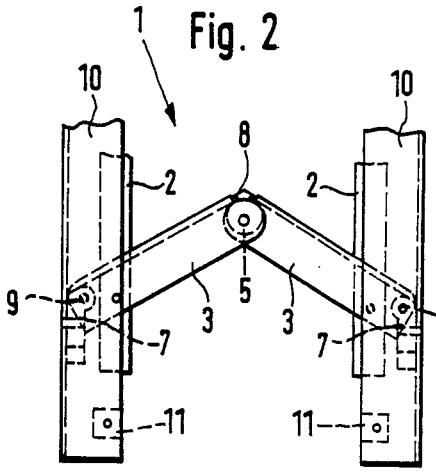
FIG. 2 is a front view of the foldable ladder of the FIG. 1 embodiment in a partially folded-together position.

As shown in FIGS. 1 through 4, a foldable ladder (1) includes a plurality of collapsible rungs or crosspieces (3), each of which has a central hinge (4) and two opposite hinges (9) having pivot axes (6) which are mounted inside two parallel rails or sidepieces (10).

In FIG. 2, the pivotal movement of crosspiece segments 3*a* which causes each crosspiece to "double up" is synchronized from crosspiece to crosspiece (3) by a means of two push rails or linkages (2) on the left and right and tied by rivet joints (19) to the crosspiece segments 3*a* whereby the intersection point of pivot axes (19) to the push-rail rivets (16) must be positioned with great precision.

Figure 1:
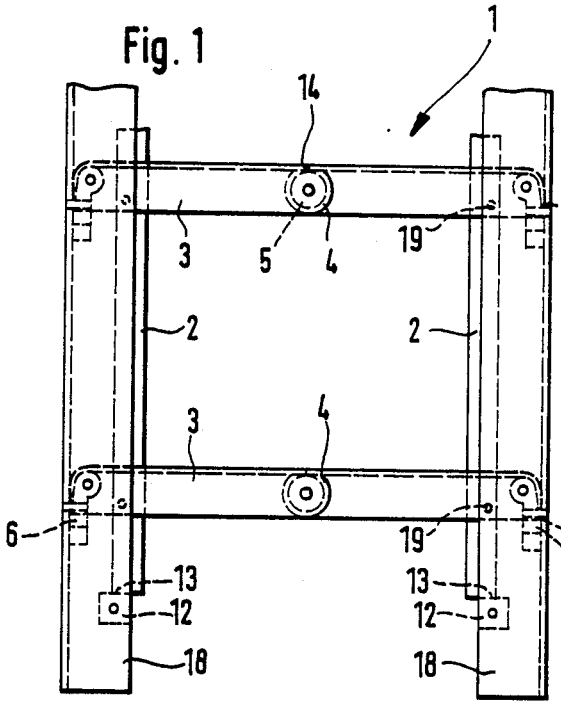
FIG. 1 is a front view of a portion of a foldable ladder according to a first preferred embodiment of the present invention in a working position.

FIG. 1 shows the ladder (1) positioned so that crosspiece segments 3*a* are firmly anchored with flat end surfaces (7) in the working position (with the crosspieces in the extended position) abutting flat inner surfaces (10*a*) of the sidepieces (10). Opposite flat end surfaces (8) of a pair of crosspiece segments 3*a* also abut at the central hinge (4) above the distance rollers (5) to reinforce and maintain the horizontal disposition of the crosspieces (3) provided by the coaction of the hinges (9) fitted inside the sidepieces (10) at the opposite ends of the crosspieces (3).

Figure 3:
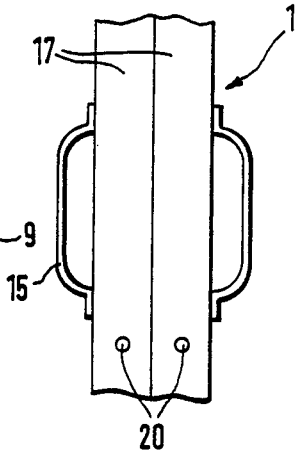
FIG. 3 is a front view of a completely folded-together ladder of the FIG. 1 embodiment.

In FIG. 3, the ladder can be seen in its folded position as a space-saving rectangular bar, with opposite sides (17) of the sidepieces (10) juxtaposed.

Figure 5:
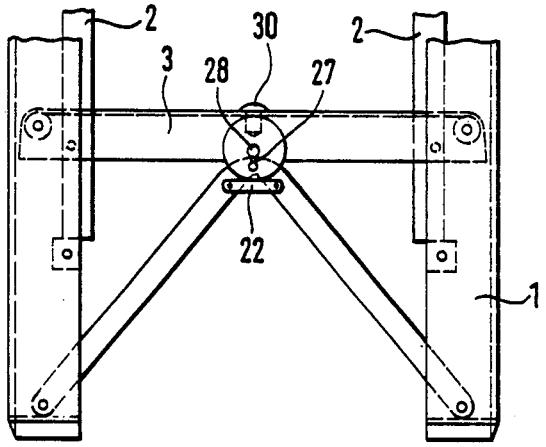
FIG. 5 is a front view of a ladder-base section of the foldable ladder of the FIG. 1 embodiment with bracketing rods.
Figure 6:
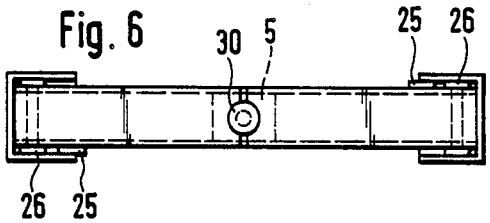
FIG. 6 is a top view of a lower extended crosspiece of the FIG. 1 embodiment.

Referring to FIGS. 5 and 6, each of the sidepieces (10) is U-shaped in cross-section and includes an end wall (10*a*) and two, parallel sidewalls (10*b*) and (10*c*). The linkages (2) have bottom ends (2*a*) which abut the block (12) when the crosspieces are in the horizontally extended position. Each crosspiece segment (3) has a top wall (3*b*) and two opposite sidewalls (3*c*). When the crosspieces are in the horizontally extended position, the linkages (2) slide in between and in contact with opposing surfaces of the sidewall (10*c*) of the sidepieces (10). Moreover, the pivot points (2*b*) of the linkages (2) are vertically aligned with the blocks (12) and spaced inwardly from the vertically aligned side pivot points (10*d*) of the sidepieces (10). A locking detent (20) may be used to provide a locking capability. Handles (15) facilitate carrying the folded ladder.

Figure 4:
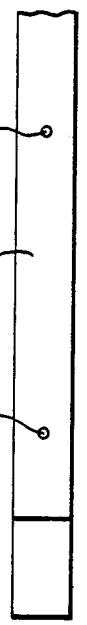
FIG. 4 shows a connecting push rail for connecting the crosspieces used in the foldable ladder of the FIG. 1 embodiment.

In FIG. 4, a linkage (2) is shown with rivets (16).

According to FIG. 5, in the working position of the foldable ladder the bracketing rods (21) are anchored by the central holding bracket (22). The rods (21) are locked into position in the ladder-foot base portion (23) for support by pins 23*a*, whereby a counterbrace is provided which tends to steady the ladder. The crosspieces are stabilized by the distance roller (5) which includes a locking core pin (30) which stops rotational movement when rotated about pin (28) to the position shown in FIG. 5. The locking pin (27) connects the connecting rods (21) to the crosspieces (3*a*) through the roller (5), thus providing means for locking the ladder in the extended position.

In FIG. 6, viewed from above, spacers (26) are shown on opposite sides of the crosspiece (3) for determining the distance between the U-shaped sidepieces (10). The crosspiece linkages (2) serve to raise and lower synchronously the crosspiece segments on both sides. The rails are propped in the extended state for support, as shown in FIG. 1 by ends (13) of the push rails (2) abutting blocks (12).

Figure 7:
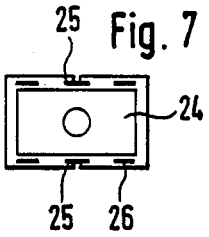
FIG. 7 shows the ladder completely folded together as a bar, viewed from above in cross section.

FIG. 7 shows the folded-together ladder, as viewed from above, as being almost square in cross section. The middle support roller (5) is shown at (24) providing for stabilization. The movable linkages (2) by means of the spacers (26), slide into the sidepieces (10). The round middle point is the end detent. The U-shaped sidepieces (10) are shown pushed together.

Figure 8:
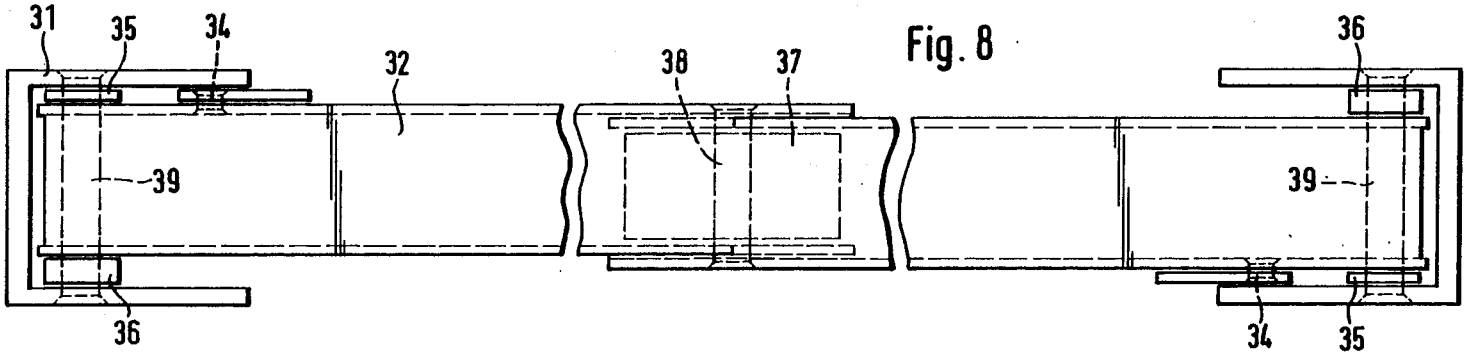
FIG. 8 is a top view of another embodiment of the present invention.
Figure 9:
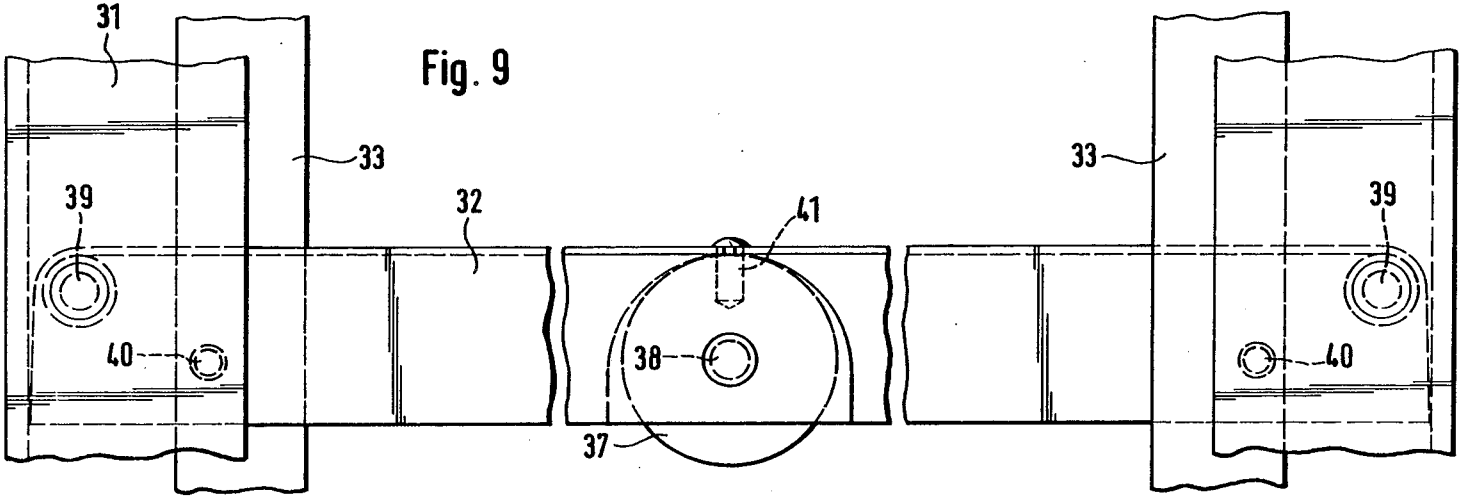
FIG. 9 is a front view of the embodiment of FIG. 8.
Figure 10:
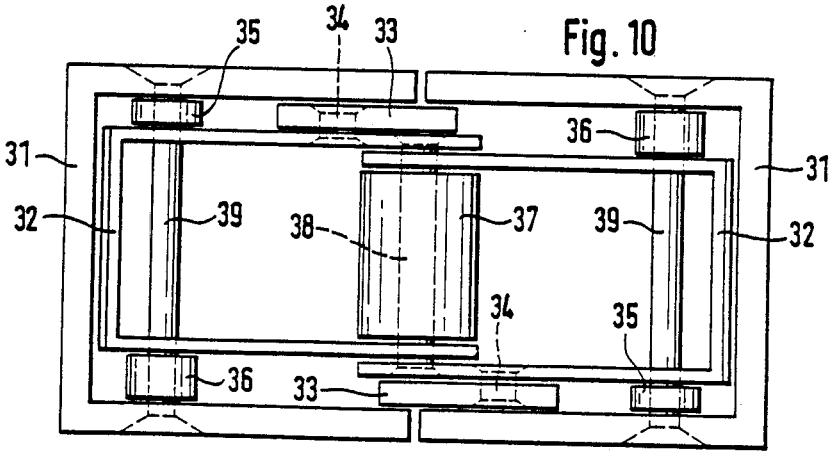
FIG. 10 is a top view of the embodiment of FIG. 8 in the completely folded position.

FIGS. 8–10 show further embodiments of the invention by way of example.

In FIGS. 8 and 9 are shown: at (31) the sidepieces and at (32) the collapsible crosspieces, at (33) the displaced linkages, at (34) the hinge rivets determining the precise distance from crosspieces to crosspieces for the uniform pushing of the crosspieces, at (35) the spacers fitted to the linkage on the pivot pin (39) connecting (31) and (32), and at (36) spacers for the mutual displacement of the crosspieces, at (37) a support distance roller, at (38) the pin connecting the crosspieces. Pivot pins (39) anchor the crosspieces to the sidepieces. Pivot pins (34) ensure that the linkages connect the crosspieces at all points of the 90-degree torque for synchronous up-and-down movement whereby in the end folded-together position the linkages protrude slightly into the opposite sidepieces, as shown in FIG. 10. At (41) is disposed a detent for the extended crosspiece. In this way, the stabilization of the bar-shaped ladder as a folded-together ladder is also shown.

We claim:

1. A foldable ladder comprising:

first and second opposite side rails;

a plurality of articulate crosspieces disposed between the first and second rails, each being movable between a folded position and an extended position;

means, connected to the plurality of crosspieces, for synchronizing the movement of the plurality of crosspieces;

each articulate crosspiece including a first crosspiece segment having a distal end and a proximal end pivotally connected to the first rail, and a second crosspiece segment having a distal end and a proximal end pivotally connected to the second rail, and a central hinge pivotally connecting the distal ends of the first and second crosspiece segments to each other; and bracket rods having first and second ends, the first ends being connected respectively to lower end portions of the first and second rails, and the second ends being connected to the central hinge of a lowermost one of the crosspieces through rotatable locking means interposed between said second ends and said center hinge, thereby bracing the crosspieces when in the extended position.

2. A foldable ladder according to claim 1, wherein each articulate crosspiece includes a first crosspiece segment having a distal end and a proximal end pivotally connected to the first rail, and a second crosspiece segment having a distal end and a proximal end pivotally connected to the second rail, and a central hinge pivotally connecting the distal ends of the first and second crosspiece segments to each other.

3. A foldable ladder according to claim 1, wherein the synchronizing means comprises a first linkage pivotally connected to each of the first crosspiece segments.

4. A foldable ladder according to claim 3, wherein the synchronizing means further comprises a second linkage pivotally connected to each of the second crosspiece segments.

5. A foldable ladder according to claim 4, further comprising a plurality of rail rivets for pivotally connecting the first and second crosspiece segments to the first and second rails, respectively, and a plurality of linkage rivets for connecting the first and second crosspieces to the first and second linkages, respectively, wherein the rail rivets have an axis which is offset from an axis of the linkage rivets so that translatory movement of the first and second linkages imparts pivotal movement in the first and second crosspiece segments.

6. A foldable ladder according to claim 1, wherein the distal ends of the first and second crosspiece segments for each crosspiece abut each other in the extended position while the proximal ends abut the first and second rails, and wherein the abutment of the proximal and distal ends of each crosspiece segment provides means for supporting each crosspiece in the extended position.

7. A foldable ladder according to claim 1, wherein the first and second rails are U-shaped, and the first and second crosspiece segments fold into the first and second rails in the folded position.

8. A foldable ladder according to claim 1, further comprising spacers provided between the proximal ends of the first and second crosspiece segments and the first and second rails.

9. A foldable ladder according to claim 1, wherein the locking means comprises a roller of the central hinge and having a lower end for receiving an upper end of the bracket rods, a locking pin for interconnecting the upper end of the bracket rods to the lower end of the roller, and a core pin connected to an upper end of the roller and being disposed between the first and second crosspiece segment.

10. A foldable ladder comprising:

first and second parallel, opposite side rails, each being substantially U-shaped in cross-section to define an end wall and two parallel sidewalls, each of the sidewalls and the end wall having inner and outer surfaces;

a plurality of articulate crosspieces, each made of two centrally linked crosspiece segments pivotally connected at vertically aligned side pivot points to and disposed between the first and second rails, each articulate crosspiece being movable between a substantially vertical folded position and a horizontally extended position and each having a top wall and two opposite side walls;

first and second parallel sliding rails, each being pivotally connected at vertically aligned pivot points to the plurality of articulate crosspieces and having a bottom end; and first and second blocks disposed respectively on lower end portions of the first and second side rails and being disposed in abutment with the bottom ends of the first and second sliding rails when the plurality of articulate crosspieces are in the horizontally extended position, the pivot points of the sliding rails being spaced inwardly from the side pivot points of the crosspieces in substantial vertical alignment with the first and second blocks so that weight applied to the crosspieces is transferred to the first and second blocks, and the first and second sliding rails being disposed between and contacting opposing surfaces of one of the sidewalls of the first and second side rails and an opposing side wall of the plurality of articulate crosspieces when the crosspieces are in the horizontally extended position.

11. A foldable ladder according to claim 10, further comprising locking means for locking the plurality of articulate crosspieces in the horizontally extended position.

12. A foldable ladder according to claim 11, wherein said locking means comprises bracket rods extending between a lower end portion of the side rails and a lowermost crosspiece, a roller of the central hinge of the lowermost crosspiece and having a lower end for receiving an upper end of the bracket rods, a locking pin for interconnecting the upper end of the bracket rods to the lower end of the roller, and a core pin connected to an upper end of the roller and being disposed between the first and second crosspiece segment.

* * * * *